US006163001A

United States Patent [19]

Zehnder et al.

[11] Patent Number: 6,163,001

[45] Date of Patent: Dec. 19, 2000

[54] PUFFER TYPE CIRCUIT BREAKER WITH ARCING CHAMBER, AUXILIARY SHUNTING CONTACTS AND EXHAUST STRUCTURE WITH PRESSURE RELIEF VALVES

[75] Inventors: Lukas Zehnder, Baden-Dattwil; Kurt Kaltenegger, Lengnau; Lutz Niemeyer, Birr; Thomas Schoenemann, Buchs; Gunter Speckhofer, Baden, all of Switzerland

[73] Assignee: ABB Research Ltd., Zurich, Switzerland

[21] Appl. No.: 09/290,386

[22] Filed: Apr. 13, 1999

[30] Foreign Application Priority Data

Apr. 14, 1998 [DE] Germany ..... 198 16 505

[51] Int. Cl.[7] ..... H01H 33/02

[52] U.S. Cl. ..... 218/11; 218/46; 218/54; 218/59; 218/65; 218/66; 218/76

[58] Field of Search ..... 218/43, 46–53, 218/56, 57, 59–65, 74, 76, 90, 146, 155–158, 68, 11

[56] References Cited

U.S. PATENT DOCUMENTS

| | | | |
|---|---|---|---|
| 4,486,632 | 12/1984 | Niemeyer et al. | 218/57 |
| 4,650,941 | 3/1987 | Thuries et al. | 218/60 X |
| 4,684,773 | 8/1987 | Niemeyer | 218/53 |
| 4,716,266 | 12/1987 | Muscaglione et al. | 200/252 X |
| 5,723,840 | 3/1998 | Bojic et al. | 218/60 |
| 5,902,978 | 5/1999 | Zehuder et al. | 218/57 |

FOREIGN PATENT DOCUMENTS

| | | |
|---|---|---|
| 0177714B1 | 4/1986 | European Pat. Off. . |
| 0456139B1 | 11/1991 | European Pat. Off. . |
| 3833564A1 | 6/1989 | Germany . |
| 4322351A1 | 1/1995 | Germany . |
| 19517540A1 | 11/1996 | Germany . |
| 19613568A1 | 10/1997 | Germany . |
| 19641550A1 | 4/1998 | Germany . |

*Primary Examiner*—J. R. Scott

*Attorney, Agent, or Firm*—Burns, Doane, Swecker & Mathis, L.L.P.

[57] ABSTRACT

Arranged in the continuation of an arcing chamber (16) bounded by consumable rings (32*a,* 32*b*) are pressure chambers (25*a,* 25*b*) which are connected in each case to a heating volume (18), which concentrically surrounds the arcing chamber (16), via a return channel (28; 28*b*), which is rotationally symmetrical with reference to the switching axis and is at least initially of increasing cross section, and a non-return valve (29*a;* 29*b*). A circumferential blowout slot (19) opening into the arcing chamber (16) between the consumable rings (32*a,* 32*b*) issues from the heating volume (18). The pressure chambers (25*a,* 25*b*) are, moreover, connected via in each case a plurality of exhaust tubes (34*a,* 34*b*) to exhaust volumes (30*a,* 30*b*) and to one of them also via a pressure relief valve (37). The pinch pressure produced between the consumable rings (32*a,* 32*b*) during formation of an arc (17) leads to a pressure buildup in the pressure chambers (25*a,* 25*b*) which contributes via the return channels (28*a,* 28*b*) to building up in the heating volume (18) a high blowout pressure which on the occasion of the next zero crossing causes a strong gas flow through the blowout slot (19) into the arcing chamber (16), which quenches the arc (17).

28 Claims, 4 Drawing Sheets

PUFFER TYPE CIRCUIT BREAKER WITH ARCING CHAMBER, AUXILIARY SHUNTING CONTACTS AND EXHAUST STRUCTURE WITH PRESSURE RELIEF VALVES

BACKGROUND OF THE INVENTION

1. Field of the Invention

The invention relates to a circuit-breaker such as those used in power plants, transformer substations and other installations in the supply of electric energy for connecting and disconnecting operating currents and overcurrents.

2. Discussion of Background

EP-B-0 177 714 has disclosed a circuit-breaker of the generic type in which the pressure volume is connected to the exhaust only via the heating volume. Consequently, it is impossible for the pressure chamber to be directly relieved in the case of high current strengths. In order to avoid overpressures in the case of high current strengths, the pressure chamber and heating volume must therefore be appropriately designed so that the pressure buildup in the case of relatively low currents can make only a slight contribution to quenching the arc. In the case of known circuit-breakers of the generic type, the arcing chamber is therefore connected directly to the exhaust in order to avoid overpressures. A circuit-breaker of the same type of design has been disclosed in EP-A-0 456 139.

Although in the case of the circuit-breaker in accordance with DE-A-196 13 568, the arc is crossed by the gas flow and very effectively blown out, only some of the pressure built up by the heating of the gas by the arc is utilized for blowing out, with the result that most fields of use require an additional mechanical blowout device of comparatively large dimensions.

SUMMARY OF THE INVENTION

Accordingly, one object of the invention is, by contrast, to provide a breaker of the generic type in which the energy output of the arc, in particular the pinch pressure, is utilized as effectively as possible for blowing out the arc, with the result that a quick interruption of the circuit is ensured even in the case of high switching capacities and without mechanical blowout devices of large dimension which require high power of the switching drive. At the same time, however, the aim is to avoid overloading the breaker by overpressure in the case of very high currents.

This is achieved according to the invention by having at least one pressure chamber which is connected to the arcing chamber and the heating volume, and which includes an exhaust which connects the pressure chamber to an exhaust volume, thereby ensuring that after an intense pressure buildup in the extinguishing gas the arc is intensively blown out at least over a large portion of its length and is thereby effectively cooled. The connection between the pressure chamber and the exhaust volume simultaneously ensures that overpressures are quickly reduced.

It is particularly advantageous for the circuit-breaker according to the invention to have, surrounding the switching axis, an opening formed by the first contact member into which the second contact member projects in a fashion touching the edge of the opening in the closed position, and which connects the pressure chamber to the arcing chamber in the open position. In this design the gas flow, which is very strong owing to the high pressure, crosses the arc positively and thereby dissolves it and interrupts it reliably.

Further particularly advantageous embodiments are to be gathered from the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
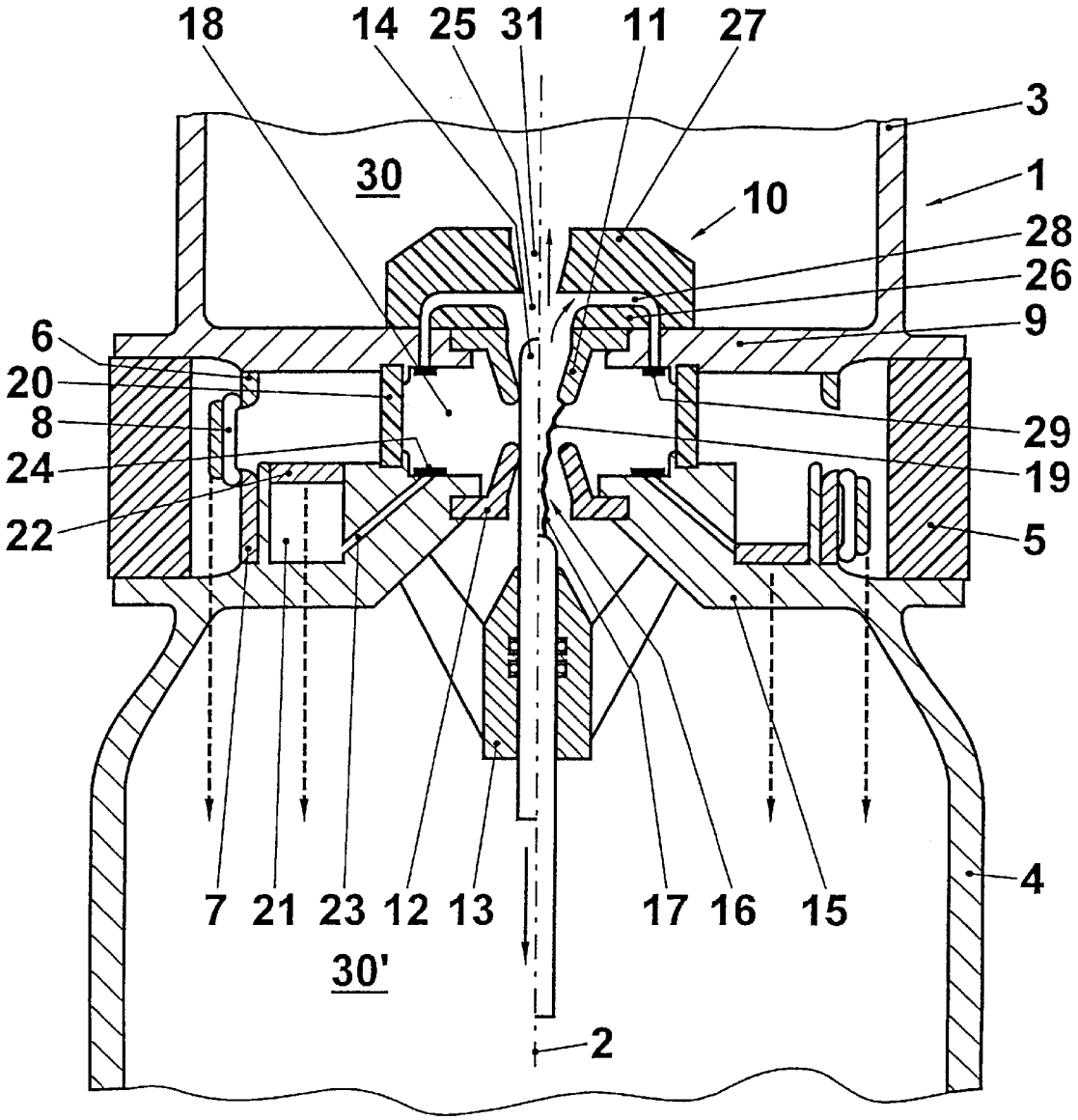
FIG. 1 shows a partial axial longitudinal section through a circuit-breaker in accordance with a first embodiment of the invention.

Referring now to the drawings, wherein like reference numerals designate identical or corresponding parts throughout the several views, the circuit-breaker in accordance with a first embodiment is shown in FIG. 1. As illustrated, the circuit breaker is in the closed position on the left and in the open position on the right has a housing 1 which is essentially rotationally symmetrical about a switching axis 2 and has an upper housing part 3 and a lower housing part 4, both made from metal, which are connected by a cylindrical middle housing part 5 made from an insulating material. The housing parts 3, 4 are connected in each case to the opposite terminals of the circuit-breaker.

Constructed outside at the level of the middle housing part 5 is a nominal current path which comprises circumferential fixed nominal current contacts, which are respectively connected to the upper housing part 3 and the lower housing part 4 and separated from one another in the axial direction. The current contacts include an upper fixed nominal current contact 6 and a lower fixed nominal current contact 7 and a movable nominal current contact 8 with contact fingers which follow one another in the circumferential direction and in each case bridge the spacing between the fixed nominal current contacts 6, 7. The movable current contact 8 is connected to a switching drive (not represented) by means of which it can be shifted in the axial direction between the closed position, in which it bridges the gap between the upper fixed nominal current contact 6 and the lower fixed nominal current contact 7, and the open position, in which it is separated from the upper fixed nominal current contact 6.

The upper housing part 3 is sealed below by a horizontal partition 9. The partition 9 supports the fixed part of a consumable switchgear arrangement 10. Mounted in a central opening of the partition 9 so as to define a first contact member is a tulip contact 11 with a plurality of elastic contact fingers which follow one another in the circumferential direction, are directed obliquely downward and toward the switching axis 2, and are separated by slots. Arranged opposite the tulip contact 11 is a nozzle 12 which surrounds the switching axis 2 and is made from electrically insulating material and has the shape of an upwardly narrowing funnel. In a slideway 13 which is arranged in the lower housing part 4 and also makes a connection which is a good electric conductor, there is mounted so as to define a second contact member a contact pin 14 which can be moved axially by means of the switching drive and projects into the tulip contact 11 in the closed position and is touched on the outside by the contact fingers thereof. In this arrangement, said contact fingers are deformed elastically, with the result that they exert a comparatively high contact pressure on the contact pin 14. The slideway 13 is anchored on a partition 15 which seals the lower housing part 4 from above. The nozzle 12 is fastened in a central opening in the partition 15.

In the open position, the contact pin 14 is drawn downward, with the result that its tip is situated below the nozzle 12. There is then situated between the tulip contact 11 and the contact pin 14 an arcing chamber 16 in which an arc 17 has formed between the said contact members. The arcing chamber 16 is surrounded by a coherent annular heating volume 18 which is connected to it via the gap which separates the tulip contact 11 from the nozzle 12 and forms a circumferential blowout slot 19. The heating volume 18 is sealed on the outside by a circumferential wall 20 made from insulating material. Arranged on the partition 15 are a plurality of, for example, four, blowout cylinders 21 distributed over the circumference and having blowout pistons 22 which can be actuated by the switching drive and are respectively connected to the heating volume 18 via blowout channels 23. Non-return valves 24 are installed in each case in the openings of the blowout channels 23 into the heating volume 18.

Adjoining the arcing chamber 16 above and separated therefrom by the opening formed by the ends of the contact fingers of the tulip contact 11 is a pressure chamber 25 which is bounded by the upwardly widening tulip contact 11 and an adjoining annular cover 26 as well as by a cap 27, both made from electrically insulating material, the latter surrounding the cover 26 with a spacing and abutting the partition 9 outside the same. The cover 26 and the cap 27 separated there from form between themselves a return channel 28 which is rotationally symmetrical about the switching axis 2 and leads radially outward on all sides from the pressure chamber 25, with the result that its cross section widens continuously and then bends downward and is guided in the axial direction to the heating volume 18. A non-return value 29 is installed in the opening of the return channel 28 into the heating volume 18. A central exhaust opening 31 is provided in the cap 27 as an exhaust which connects the pressure chamber 25 to the interior of the upper housing part 3, which serves as exhaust volume 30. A further exhaust volume 30' in the lower housing part 4 adjoins the arcing chamber 16 below. The entire housing 1 is filled with an insulating gas, preferably $SF_6$.

The pressure chamber 25 and the return channel 28, possibly also the heating volume 18, can be lined with a layer several millimeters thick and made from a suitable material, for example from polyoxymethylene, very high-molecular weight polyethylene, polypropylene, plexiglass, polytetrafluoroethylene, melamine resins or other plastics, which can possibly have added to them highly volatile fillers. Since the quality requirements are not very high, it is also possible to use recycled materials. If the pressure chamber, return channel and, possibly, the heating volume are not, as presented, installed in parts consisting of electrically insulating material, but in ones made from metal, such a lining is particularly useful, since it substantially reduces the intrusion of metal vapor into the insulating gas, which leads to a worsening of the dielectric properties of the same. Moreover, vaporization of the material increases the quantity of gas and the gas pressure, and energy is absorbed at the same time, both of which contribute to an improvement in the extinguishing effect.

An opening operation therefore proceeds as follows:

Starting from the closed position represented on the left, the effect of the switching drive (not represented) is to move downward the movable nominal current contact 8, the contact pin 14 and the blowout pistons 22. Promptly after the start of this movement, the movable nominal current contact 8 separates from the upper fixed nominal current contact 6, as a result of which the nominal current path is interrupted and the current is commutated onto the consumable switchgear arrangement 10. Somewhat later, the contact pin 14 is drawn from the tulip contact 11. There is formed between these contact members an arc 17 which extends at the end of the switching movement through the arcing chamber 16 which has been opened by the movement of the contact pin 14 over the arc gap. The heat radiated into the heating volume 18 from the arc 17 through the blowout slot 19 strongly heats the insulating gas in the same, with the result that a high pressure develops in the heating volume 18.

The pressure buildup is supported by the movement of the blowout pistons 22, which causes insulating gas to flow from the blowout cylinders 21 into the heating volume 18 via the blowout channels 23. If the pressure also built up by other influences overshoots the blowout pressure, the non-return valves 24 close and prevent gas from flowing out of the heating volume 18 into the blowout channels 23.

A further, very important contribution to the pressure buildup in the heating volume 18 is supplied by the pinch pressure of the arc 17, which is produced by a rapid contraction of the same in the region of the switching axis 2, and briefly causes a strong axial flow from the arcing chamber 16 into the pressure chamber 25 and an intense pressure rise in the same. This pressure is partly diverted into the heating volume 18 via the return channel 28. It is favorable in this case that the flow resistance in the return channel 28 is very slight owing to the tightening of the cross section of the same and to its direct guidance and construction without internals. The non-return valve 29 at the opening of the return channel 28 into the heating volume 18 in turn prevents the gas from flowing out of the heating volume 18 when the pressure there overshoots that in the pressure chamber 25, which usually diminishes relatively quickly.

In the case of very high currents, a pinch pressure is produced which is so high that a complete return of the gas into the heating volume would necessarily lead to mechanical and thermal overloading of the consumable switchgear arrangement 10. Excess pressure is therefore diverted directly into the exhaust volume 30 via the exhaust opening 31. The central arrangement of the exhaust opening 31 is advantageous in this case since excessively high pinch pressure chiefly produces an axial pressure surge which escapes harmlessly through the exhaust opening 31, while the general pressure buildup in the pressure chamber 25 is not essentially influenced. It is therefore relatively independent of the current strength.

After the buildup of a high pressure in the heating volume 18, during the next zero crossing, the arc 17 is extinguished via virtue of the fact that the insulating gas blows away from the heating volume 18 partly through the blowout slot 19 and the tulip contact 11 into the pressure chamber 25 in which the pressure has already fallen steeply by this instant, and blows away further into the exhaust volume 30 through the exhaust opening 31. In this case, the gas flow crosses the arc gap positively and removes largely all the ionized gases in the crossing region, with the result that no arc can form any more after the zero crossing. The other part of the insulating gas flows parallel to the arc gap 16 through the nozzle 12 into the further exhaust volume 30'.

Figure 2:
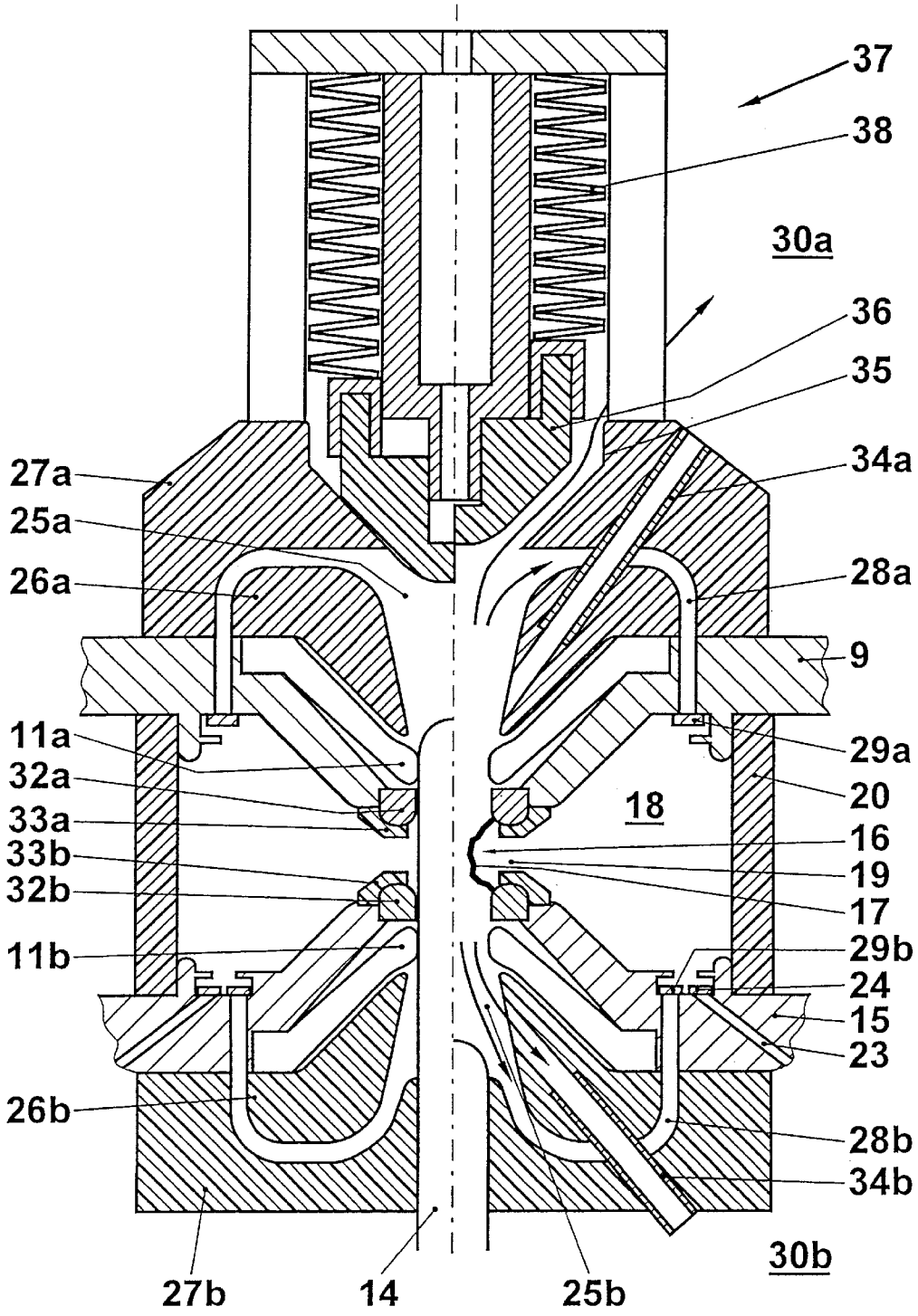
FIG. 2 shows an axial longitudinal section through the consumable switchgear arrangement of a circuit-breaker in accordance with a second embodiment of the invention, the plane of section being rotated in the right-hand half by 45° with respect to the left-hand half.

The consumable switchgear arrangement, represented in FIG. 2, in accordance with the second embodiment of the circuit-breaker according to the invention, which otherwise can essentially be of the same design as the circuit-breaker in accordance with the first embodiment, corresponds in basic design and many details to the consumable switchgear arrangement described there. However, the first contact member has in addition to a tulip contact 11*a* a consumable ring 32*a* which is arranged upstream of the same in the opening direction and is connected to it in an electrically conducting fashion, and whose inside diameter is slightly larger than the diameter of the contact pin 14. In addition to the axially shiftable contact pin 14, the second contact member comprises a fixed tulip contact 11*b* connected to the partition 15 in an electrically conducting fashion, and a likewise fixed consumable ring 32*b,* which is arranged upstream of the tulip contact 11*b* in the closing direction and is connected to it in an electrically conducting fashion. The two consumable rings 32*a,b* are situated opposite one another in a fashion respectively shielded by a ring 33*a* or 33*b* made from electrically insulating material and separated by the circumferential blowout slot 19, which connects the heating volume 18, surrounded by a circumferential wall 20 made from electrically insulating material, with the arcing chamber 16 situated between the consumable rings 32*a,b.*

Blowout channels 23 which are sealed by non-return valves 24 open into the heating volume 18 and connect the same to blowout cylinders (not represented). Provided on both sides in the axial continuation of the arcing chamber 16 are pressure chambers 25*a,b* which are bounded laterally by annular covers 26*a,b* of the tulip contacts 11*a,b.* The covers 26*a,b* and the caps 27*a,b* surrounding the same at a spacing respectively form between them a return channel 28*a* and 28*b,* respectively, which is firstly led radially outward and then, in a fashion bent away axially and led back to the heating volume 18, opens into the latter via a non-return valve 29*a* and 29*b,* respectively.

The pressure chamber 25*a* is connected via a plurality of, for example, four, exhaust tubes 34*a,* which start on the side wall of the pressure chamber and which are directed obliquely upward and outward and which cross the return channel 28*a,* to an exhaust volume 30*a.* The and the pressure chamber 25*b* is connected in the same way via appropriate exhaust tubes 34*b* to an exhaust volume 30*b.* The pressure chamber 25*a* which is arranged on the side of the first contact member, is, moreover, connected via a central, upwardly widening relief opening 35 in the cap 27*a* to the exhaust volume 20*a.* This opening 35 is, however, sealed by a roundedly frustoconical piston 36 of a pressure relief valve 37, which piston is pressed into the opening 35 by disk springs 38.

During opening, the contact pin 14 is firstly drawn from the tulip contact 11*a.* In this process, an arc is produced between these parts which, when the tip of the contact pin 14 is drawn through the consumable ring 32*a,* is commutated from the tulip contact 11*a* onto the ring 32*a.* When the tip of the contact pin 14 then passes the further consumable ring 32*b,* the other end of the arc commutates onto the ring 32*b.* The arc now connects two consumable rings 32*a,b.* The contact pin 14 is moved further downward, until it has cleared the pressure chamber 25*b.*

A high pressure is built up in the heating volume 18 essentially in the same way as already outlined in conjunction with the first exemplary embodiment. In this case, the pinch pressure is completely utilized by the double construction of the pressure chamber and return channel. Overpressure is diverted as a rule into the exhaust volumes 30*a,b* through the exhaust tubes 34*a* and 34*b,* which are dimensioned such that they do not prevent a normal pressure buildup in the pressure chambers 25*a,b.* If, for example because of a very high strength of the current to be interrupted, the pressure rises very steeply in the pressure chamber 25*a,* in particular a strong axial pressure surge is produced, the pressure release valve 37 then, as represented in FIG. 2 on the right, clears the relief opening 35 and thus creates additional pressure relief.

In the case of the embodiment outlined, the utilization of the arc energy for the pressure buildup is comprehensive, since the arcing chamber 16 is connected to an exhaust volume not directly, but only via the pressure chambers 25*a,b.* It is surrounded on all sides by spaces which contribute to the pressure buildup, specifically the heating volume 18 and the pressure charters 25*a,b.* However, there is no risk of overloading, thanks to the exhaust tubes 34*a,b,* which connect said pressure chambers to the exhaust volumes 30*a,b,* and to the pressure relief valve 37.

Figure 3A:
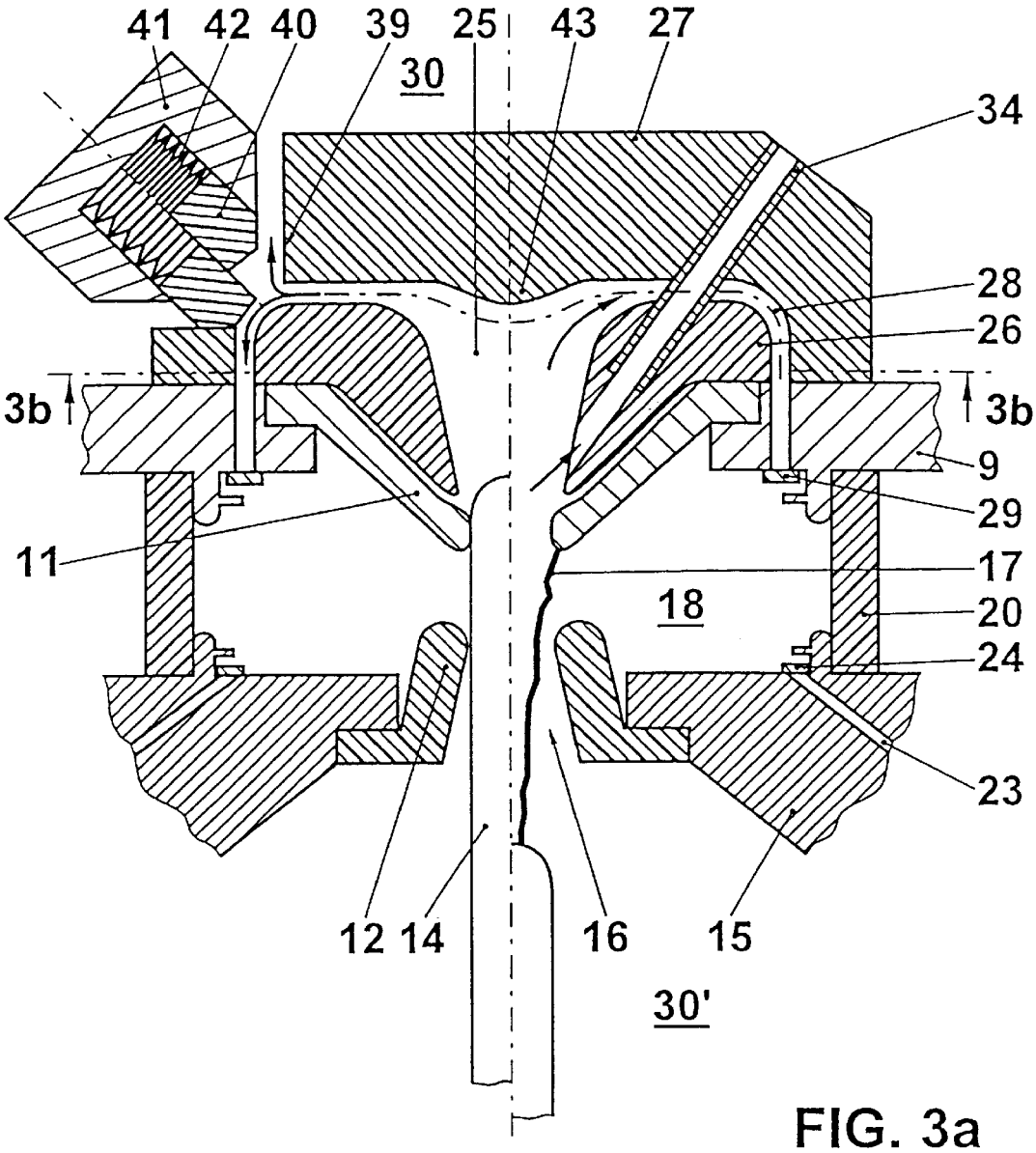
FIG. 3*a* shows an axial longitudinal section through the consumable switchgear arrangement of a circuit-breaker in accordance with a third embodiment of the invention.
Figure 3B:
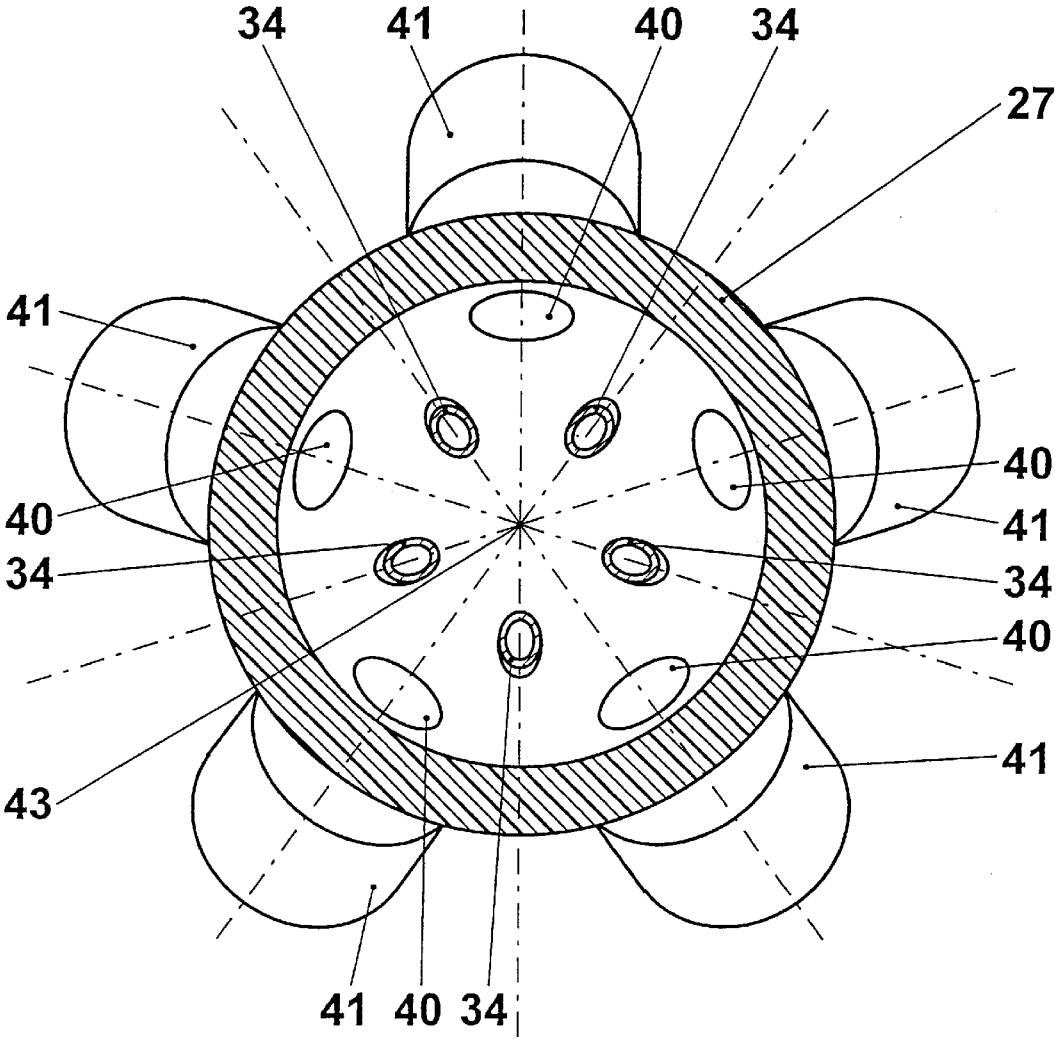
FIG. 3*b* shows a cross section along 3*b*—3*b* in FIG. 3*a*.

The consumable switchgear arrangement, represented in FIGS. 3*a* and 3*b,* in accordance with the third embodiment of the circuit-breaker according to the invention corresponds essentially, in particular in design and arrangement of the contact members, to that in accordance with the first embodiment. As to the parts of the consumable switchgear arrangement of identical design, reference is consequently made to the description there. The remaining parts of the circuit-breaker can be designed in accordance with the first embodiment.

The differences reside, chiefly, in that the cap 27 is constructed to be continuous in the center and has no exhaust opening. In a fashion similar to the case of the circuit-breaker in accordance with the second embodiment, the pressure chamber 25 is connected to the exhaust volume 30 by means in this case of five exhaust tubes 34 distributed uniformly over the circumference. Moreover, outwardly widening relief openings 39 which connect the return channel 28 to the exhaust volume 30 are provided in the cap 27, being arranged in each case preferably in the same quantity as the exhaust tubes 34 and between the exhaust tubes. They are arranged in the region in which the return channel 28 bends round from the radial into the axial direction, and are respectively sealed in a similar way as in the case of the circuit-breaker in accordance with the second embodiment by a flattened frustoconical piston 40' of a pressure relief valve 41 which is pressed by disk springs 42 into the relief opening 39.

Pressure surges produced during opening are here deflected radially outward into the return channel 28 by a central bulge 43 on the cap 27. If the pressure there is too high, the pressure relief valves 41 open to provide relief.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit-breaker comprising:

at least one consumable switchgear arrangement including:

a first contact member and a second contact member, an arcing chamber situated between said contact members, said second contact member being shiftable relative to the first contact member along a switching axis between a closed position in which the second contact member touches the first contact number and an open position in which the second contact member is separated from the first contact member in the axial direction by an arc gap and clears the arcing chamber, a heating volume connected to the arcing chamber, at least one exhaust via which the arcing chamber is connected to at least one exhaust volume, and at least one pressure chamber connected axially to the arcing chamber and which is connected to the heating volume, wherein said at least one exhaust issues from said at least one pressure chamber and connects said at least one pressure chamber to the at least one exhaust volume.

2. The circuit-breaker as claimed in claim 1, wherein surrounding the switching axis there is formed by the first contact member an opening into which the second contact member projects in a fashion touching the edge of the opening in the closed position, and which connects the pressure chamber to the arcing chamber in the open position.

3. The circuit-breaker as claimed in claim 2, wherein the first contact member is a fixed tulip contact with a plurality of contact fingers.

4. The circuit-breaker as claimed in claim 3, wherein the contact fingers are directed over at least a portion of their length at least obliquely with respect to the switching axis.

5. The circuit-breaker as claimed in claim 1, wherein the first contact member comprises a fixed consumable ring arranged in front of its remaining parts in the arcing chamber.

6. The circuit-breaker as claimed in claim 1, wherein the second contact member comprises a movable contact pin.

7. The circuit-breaker as claimed in claim 6, wherein the second contact member comprises a fixed slide tulip which surrounds the contact pin and makes electrically conducting contact with the contact pin at least in the closed position.

8. The circuit-breaker as claimed in claim 6, wherein the second contact member comprises a fixed consumable ring which surrounds the contact pin in the closed position and is arranged in front of the contact pin in the arcing chamber in the open position.

9. The circuit-breaker as claimed in claim 1, further comprising a nozzle arranged in the arcing chamber and made from electrically insulating material.

10. The circuit-breaker as claimed in claim 1, wherein the heating volume surrounds the arcing chamber in an annular fashion and has at least one blowout opening directed against the arcing chamber.

11. The circuit-breaker as claimed in claim 10, wherein the heating volume surrounds the arcing chamber in an undivided fashion, and the blowout opening is constructed as a circumferential blowout slot.

12. The circuit-breaker as claimed in claim 11, wherein the blowout slot is situated between the consumable ring of the first contact member and the consumable ring of the second contact member.

13. The circuit-breaker as claimed in claim 1, wherein the connection between the pressure chamber and the heating volume is made via at least one return channel which extends approximately radially outward and subsequently bends toward the heating volume in an approximately axial direction.

14. The circuit-breaker as claimed in claim 13, wherein the cross section of the return channel increases over a portion extending from the pressure chamber to the heating volume.

15. The circuit-breaker as claimed in claim 13, wherein the cross section of a part of the return channel adjoining the pressure chamber increases.

16. The circuit-breaker as claimed in claim 13, wherein the return channel is constructed in an essentially rotationally symmetrical fashion with reference to the switching axis.

17. The circuit-breaker as claimed in claim 13, wherein the return channel has a non-return valve.

18. The circuit-breaker as claimed in claim 1, wherein the connection between the arcing chamber and the at least one exhaust volume is made only via the at least one pressure chamber.

19. The circuit-breaker as claimed in claim 1, wherein said at least one pressure chamber comprises two pressure chambers which are situated opposite one another separated by the arcing chamber and are connected in each case to the heating volume.

20. The circuit-breaker as claimed in claim 1, wherein the exhaust of at least one pressure chamber comprises a plurality of eccentrically arranged exhaust tubes connecting said pressure chamber to the exhaust volume.

21. The circuit-breaker as claimed in claim 1, wherein the exhaust of at least one pressure chamber comprises a central axial exhaust opening at the end opposite the arcing chamber.

22. The circuit-breaker as claimed in claim 1, wherein the pressure chamber is connected to the exhaust volume via at least one pressure relief valve.

23. The circuit-breaker as claimed in claim 22, wherein a pressure relief valve is arranged centrally at the end of the pressure chamber opposite the arcing chamber.

24. The circuit-breaker as claimed in claim 13, wherein a plurality of pressure relief valves are arranged on the outside of the return channel.

25. The circuit-breaker as claimed in claim 1, wherein a part of at least one of the pressure chamber and the return channel are lined with a plastic material.

26. The circuit-breaker as claimed in claim 25, wherein the plastic material is polyoxymethylene, polyethylene, polypropylene, plexiglass, polytetra-fluoroethylene or melamine resin.

27. The circuit-breaker as in claimed claim 1, wherein it has at least one blowout cylinder with a blowout piston which is actuated during opening and is connected to the heating volume.

28. The circuit-breaker as claimed in claim 1, wherein a nominal current switchgear arrangement is provided in parallel with the consumable switchgear arrangement.

* * * * *